US010766252B2

(12) United States Patent
Ishihara et al.

(10) Patent No.: US 10,766,252 B2
(45) Date of Patent: Sep. 8, 2020

(54) HEATER AND INKJET PRINTER

(71) Applicant: Konica Minolta, Inc., Tokyo (JP)

(72) Inventors: Yasuhiro Ishihara, Toyohashi (JP); Yuhei Tatsumoto, Toyokawa (JP); Toshikazu Higashi, Toyokawa (JP); Makoto Shimazoe, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/502,961

(22) Filed: Jul. 3, 2019

(65) Prior Publication Data

US 2020/0031114 A1 Jan. 30, 2020

(30) Foreign Application Priority Data

Jul. 30, 2018 (JP) ..... 2018-142650

(51) Int. Cl.
*B41J 2/045* (2006.01)

(52) U.S. Cl.
CPC ..... *B41J 2/0451* (2013.01); *B41J 2/04563* (2013.01); *B41J 2/04586* (2013.01)

(58) Field of Classification Search
CPC combination set(s) only.
See application file for complete search history.

(56) References Cited

U.S. PATENT DOCUMENTS

2012/0194587 A1* 8/2012 Teshigawara ..... B41J 2/04563 347/12

FOREIGN PATENT DOCUMENTS

JP 2002117958 A 4/2002

* cited by examiner

*Primary Examiner* — Bradley W Thies
(74) *Attorney, Agent, or Firm* — Lucas & Mercanti, LLP

(57) ABSTRACT

A heater includes: a planar heat generator; a power supply circuit that controls supply of power to the planar heat generator; a plurality of temperature sensors that is provided on the planar heat generator and measures a temperature; and a hardware processor that detects abnormality of the temperature sensor in a case where a difference in temperature measured by each of two of the temperature sensors out of the plurality of temperature sensors exceeds an abnormality threshold value after a predetermined waiting time has elapsed since the supply of power to the planar heat generator is stopped.

7 Claims, 14 Drawing Sheets

FIG. 10

| | | CASE C1 | | CASE C2 | |
|---|---|---|---|---|---|
| THERMISTOR POSITION | | BOTH TWO ARE ON LINEAR PART | | ONE IS ON LINEAR PART; ONE IS BETWEEN LINEAR PARTS | |
| EXISTENCE/NON-EXISTENCE OF THERMISTOR ABNORMALITY | | NOT EXIST | EXIST(THb) | NOT EXIST | EXIST(THb) |
| TARGET TEMPERATURE | | 85°C | | | |
| MEASURED TEMPERATURE OF THERMISTOR | THa(TP1) | 85°C | 85°C | 85°C | 85°C |
| | THb(TP2) | 85°C | 65°C | 80°C | 60°C |
| | ΔT(=\|TP1−TP2\|) | 0°C | 20°C | 5°C | 25°C |
| ABNORMALITY DETERMINATION | CONDITION FOR DETERMINATION | \|TP1−TP2\|≥5°C | | | |
| | RESULT | NORMAL | ABNORMAL | ABNORMAL (ERRONEOUS DETECTION) | ABNORMAL |

FIG. 12

| | TYPE | | INVENTIVE EXAMPLE 1 | INVENTIVE EXAMPLE 2 | INVENTIVE EXAMPLE 3 | INVENTIVE EXAMPLE 4 | INVENTIVE EXAMPLE 5 |
|---|---|---|---|---|---|---|---|
| | THERMISTOR POSITION | | CASE C1 | | CASE C2 | | |
| | | | BOTH TWO ARE ON LINEAR PART | | ONE IS ON LINEAR PART; ONE IS BETWEEN LINEAR PARTS | | |
| | EXISTENCE/NON-EXISTENCE OF THERMISTOR ABNORMALITY | | NOT EXIST | EXIST(THb) | NOT EXIST | EXIST(THa) | EXIST(THb) |
| | TARGET TEMPERATURE | | 85°C | | | | |
| DETECTED TEMPERATURE | DURING ENERGIZATION (20 SECONDS LATER FROM ENERGIZATION START) | THa | 85°C | 85°C | 85°C | 85°C | 85°C |
| | | THb | 85°C | 105°C | 80°C | 100°C | 60°C |
| | | ΔTon | 0°C | 20°C | 5°C | 15°C | 25°C |
| | DURING DE-ENERGIZATION (20 SECONDS LATER FROM ENERGIZATION STOP) | THa | 78°C | 78°C | 78°C | 78°C | 78°C |
| | | THb | 78°C | 97°C | 77°C | 92°C | 55°C |
| | | ΔToff | 0°C | 19°C | 1°C | 14°C | 23°C |
| ABNORMALITY DETERMINATION | CONDITION FOR ABNORMALITY DETERMINATION | | ΔToff≥T1 | | | | |
| | | T1 DEFAULT VALUE | 5°C | | | | |
| | | T1 UPDATED VALUE (ΔToff+3°C) | 3°C | NO UPDATE | 4°C | NO UPDATE | NO UPDATE |
| | CONDITION FOR ENERGIZATION STOP | | ΔTon≥T2 | | | | |
| | | T2 DEFAULT VALUE | 5°C | | | | |
| | | T2 UPDATED VALUE (ΔTon+3°C) | 3°C | NO UPDATE | 8°C | NO UPDATE | NO UPDATE |
| | RESULT | | NORMAL | ABNORMAL | NORMAL | ABNORMAL | ABNORMAL |

HEATER AND INKJET PRINTER

The entire disclosure of Japanese patent Application No. 2018-142650, filed on Jul. 30, 2018, is incorporated herein by reference in its entirety.

BACKGROUND

Technological Field

The present invention relates to a heater and an inkjet printer. More particularly, the present invention relates to a heater and an inkjet printer having high accuracy in detecting abnormality of a temperature sensor.

Description of the Related art

An inkjet printer is a printer that ejects small ink droplets from fine nozzles and causes them to fly and to attach to a recording medium, thereby performing printing. The inkjet printer has an advantage of being capable of printing high resolution, high quality images at high speed in a relatively inexpensive manner.

Some inkjet printers use a UV ink (ultraviolet curable ink) as ink. An inkjet printer using the UV ink conveys the UV ink stored in an ink tank to an inkjet head through an ink carriage, and ejects it from the inkjet head.

In general, while the UV ink is gelled and has high viscosity at normal temperature (about 25° C.), it is subject to solation and its viscosity is significantly reduced when heated to about 85° C. Accordingly, at the time of passing through the ink carriage, the UV ink is heated to about 85° C. to enter the state with low viscosity. In order to obtain high image quality, it is necessary to control the ejection amount of the UV ink from the inkjet head with high accuracy. In order to control the ejection amount of the UV ink with high accuracy, the temperature of the UV ink is highly accurately controlled in the ink carriage, thereby stabilizing the viscosity of the UV ink.

As a configuration for heating the UV ink, the ink carriage is attached with a planar heat generator such as a rubber heater. The rubber heater heats the UV ink by conducting heat to the ink through the ink carriage made of metal or the like.

The rubber heater includes a rubber sheet made of silicone or the like, and a heat generator (conductor) made of a nichrome wire or the like provided in the rubber sheet. The heat generator generates heat when power is supplied. The power density of the rubber heater for heating ink (about 1 $W/cm^2$) is higher than the power density of a general rubber heater (about 0.6 $W/cm^2$). Accordingly, the rubber heater for heating ink may have a risk that it becomes high temperature to the temperature at which the rubber heater emits smoke and takes fire. In order to avoid such a situation, in the rubber heater for heating ink, the surface temperature of the rubber heater is measured by a thermistor, and power supplied to the rubber heater is controlled using a thyristor such that the temperature measured by the thermistor becomes a target temperature (about 85° C.).

Note that a conventional technique related to abnormality detection of the thermistor is disclosed in, for example, JP 2002-117958 A. JP 2002-117958 A discloses a technique of providing two thermistors to a sheet heater of a motorcycle and stopping the heater when a difference between temperatures detected by the two thermistors has reached a predetermined threshold value.

The rubber heater is provided with various kinds of safety protection so as not to emit smoke or take fire when abnormality occurs. Examples of the safety protection of the rubber heater include abnormality detection of the thermistor. The abnormality detection of the thermistor indicates detection of a situation in which a temperature to be detected has entered a state that cannot be normally detected due to an error in attachment of the thermistor, adhesion of foreign matter such as paper powder and dust, a failure of the thermistor itself, or the like. Accordingly, as a result of the control of the power to be supplied to the rubber heater on the basis of the erroneous temperature detected by the thermistor, occurrence of emitting smoke or taking fire can be avoided.

Conventionally, as a specific method of detecting abnormality of the thermistor, there has been adopted a method of providing two or more thermistors for one rubber heater and monitoring a difference between temperatures measured by each of two thermistors among the thermistors. In this method, when abnormality occurs in one of the two thermistors, the difference between the temperatures measured by each of the two thermistors increases. Accordingly, abnormal is detected when the difference between the temperatures measured by each of the two thermistors becomes larger than an abnormality threshold value.

In the conventional techniques, there has been a problem that the accuracy in detecting abnormality of a temperature sensor, such as a thermistor, is low.

In general, a planar heat generator such as a rubber heater includes an insulator, and a heat generator disposed on the insulator. The heat generator includes each of a plurality of linear parts extending in parallel with each other at a predetermined interval. Accordingly, in the rubber heater, there is unevenness in temperature on the sheet plane. In the sheet plane of the rubber heater, while the temperature is high at a position near the heat generator, the temperature is low at a position between the linear parts. As a result, in the case where the temperature of the position at which each of the two thermistors is provided is different from each other, even if the two thermistors are normal, the difference in temperature measured by each of the two thermistors increases, whereby abnormality of the thermistor has been erroneously detected at times.

In order to improve the accuracy in detecting abnormality of the thermistor in the rubber heater, a method of stabilizing a positional relationship between the thermistor and the heat generator in the rubber sheet is also conceivable. However, since the position of the heat generator in the rubber heater varies among products, it has been difficult to stabilize the positional relationship between the thermistor and the heat generator.

Furthermore, in order to suppress erroneous detection of abnormality of the thermistor, a method of increasing a value of the abnormality threshold value is also conceivable. However, when the abnormality threshold value is unnecessarily increased, detection of abnormality is delayed in the case where abnormality actually occurs in the thermistor, which may result in a situation where the rubber heater is maintained at an abnormally high temperature. In particular, in the case where the rubber heater is for heating ink, image abnormality and deterioration of ink may occur if the temperature of the rubber heater continues to be abnormally high. In particular, UV ink generally deteriorates at about 100° C.

Note that the problem that the accuracy in detecting abnormality of the temperature sensor is low has not been a problem unique to only a rubber heater or an inkjet printer, but has been a problem common to all heaters including a planar heat generator and a plurality of temperature sensors provided on the planar heat generator to measure a temperature.

SUMMARY

The present invention is intended to solve the problems described above, and an object thereof is to provide a heater and an inkjet printer having high accuracy in detecting abnormality of a temperature sensor.

To achieve the abovementioned object, according to an aspect of the present invention, a heater reflecting one aspect of the present invention comprises: a planar heat generator; a power supply circuit that controls supply of power to the planar heat generator; a plurality of temperature sensors that is provided on the planar heat generator and measures a temperature; and a hardware processor that detects abnormality of the temperature sensor in a case where a difference in temperature measured by each of two of the temperature sensors out of the plurality of temperature sensors exceeds an abnormality threshold value after a predetermined waiting time has elapsed since the supply of power to the planar heat generator is stopped.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 10 is a table illustrating a result of abnormality detection of a thermistor in a conventional manner;

FIG. 12 is a table illustrating a result of abnormality detection of a thermistor according to an exemplary embodiment of the present invention.

DETAILED DESCRIPTION OF EMBODIMENTS

Hereinafter, one or more embodiments of the present invention will be described with reference to the drawings. However, the scope of the invention is not limited to the disclosed embodiments.

In the following embodiment, a case where an inkjet printer includes a heater will be described. The heater may be included in an apparatus other than the inkjet printer.

Configuration of Inkjet Recording Apparatus 1

First, a configuration of an inkjet recording apparatus 1 will be described.

Figure 1:
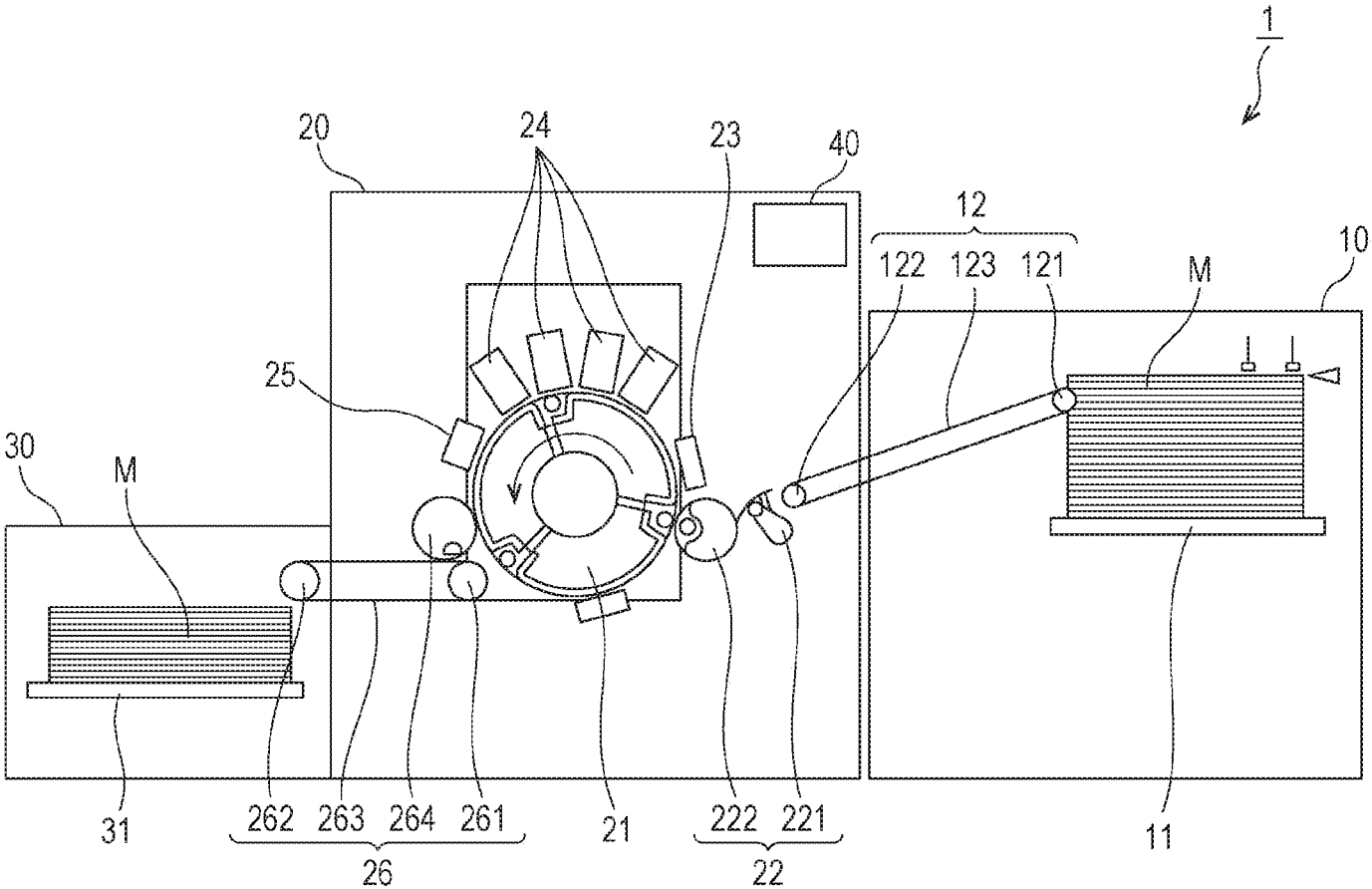
FIG. 1 is a cross-sectional view illustrating a configuration of an inkjet recording apparatus according to an embodiment of the present invention.

FIG. 1 is a cross-sectional view illustrating the configuration of the inkjet recording apparatus 1 according to an embodiment of the present invention.

Referring to FIG. 1, the inkjet recording apparatus 1 (example of the heater and the inkjet printer) according to the present embodiment includes a sheet feeder 10, an image former 20, a sheet ejector 30, and a controller 40 (example of first and second abnormality detection units, first and second stop units, a stop threshold value update unit, and a flow rate acquisition unit). The inkjet recording apparatus 1 conveys a recording medium M from the sheet feeder 10 to the image former 20 under the control of the controller 40, forms an image on the conveyed recording medium M using the image former 20, and ejects the recording medium M bearing the formed image to the sheet ejector 30.

The sheet feeder 10 holds the recording medium M on which an image is to be formed, and supplies it to the image former 20 before the image is formed. The sheet feeder 10 includes a sheet feed tray 11, and a conveyer 12.

The sheet feed tray 11 is tabular, and is capable of placing one or more recording media M thereon. The sheet feed tray 11 moves up and down according to the placed amount of the recording medium M. The sheet feed tray 11 is held at the position at which the uppermost recording medium M is conveyed by the conveyer 12.

The conveyer 12 includes a plurality of (two, in this case) rollers 121 and 122, and an annular belt 123. The belt 123 is rotationally driven by the plurality of rollers 121 and 122. The conveyer 12 includes a conveyance mechanism for conveying the recording medium M on the belt 123, and a supply unit for delivering the uppermost recording medium M placed on the sheet feed tray 11 to the belt 123. The conveyer 12 conveys, as the belt 123 rotates, the recording medium M delivered to the belt 123 by the supply unit.

The image former 20 ejects ink including the UV ink or the like onto the recording medium M to form an image on the recording medium M. The image former 20 includes an image forming drum 21, a handover unit 22, a sheet heating unit 23, a plurality of head units 24, an irradiator 25, and a delivery unit 26.

The image forming drum 21 supports the recording medium M along the cylindrical outer peripheral surface, and conveys the recording medium M as it rotates. The conveyance surface of the image forming drum 21 faces the sheet heating unit 23, the plurality of head units 24, and the irradiator 25. The image forming drum 21 performs, on the recording medium M to be conveyed, processing related to image formation.

The handover unit 22 is provided between the conveyer 12 of the sheet feeder 10 and the image forming drum 21. The handover unit 22 delivers the recording medium M conveyed by the conveyer 12 to the image forming drum 21. The handover unit 22 includes a swing arm 221, a cylindrical delivery drum 222, and the like. The swing arm 221 supports one end of the recording medium M conveyed by the conveyer 12. The delivery drum 222 delivers the recording medium M supported by the swing arm 221 to the image forming drum 21. The handover unit 22 picks up the recording medium M on the conveyer 12 using the swing arm 221 to deliver it to the delivery drum 222, whereby the recording medium M is guided along the outer peripheral surface of the image forming drum 21 and is delivered to the image forming drum 21.

The sheet heating unit 23 heats the recording medium M supported by the image forming drum 21. The sheet heating unit 23 includes, for example, an infrared heater, and generates heat in response to energization. The sheet heating unit 23 is provided in the vicinity of the outer peripheral surface of the image forming drum 21, which is on the upstream side of the head units 24 along the conveyance direction of the recording medium M based on the rotation of the image forming drum 21. The heat generation of the sheet heating unit 23 is controlled by the controller 40 such that, the recording medium M supported by the image forming drum 21, which passes near the sheet heating unit 23, is made to have a predetermined temperature.

The plurality of head units 24 ejects ink of each color of cyan (C), magenta (M), yellow (Y), and black (K) onto the recording medium M supported by the image forming drum 21, thereby forming an image on the recording medium M. The head unit 24 is individually provided for each of the colors C, M, Y, and K. In FIG. 1, the head units 24 corresponding to the respective colors Y, M, C, and K are provided in that order along the conveyance direction of the recording medium M, which is conveyed as the image forming drum 21 rotates.

Figure 2A:
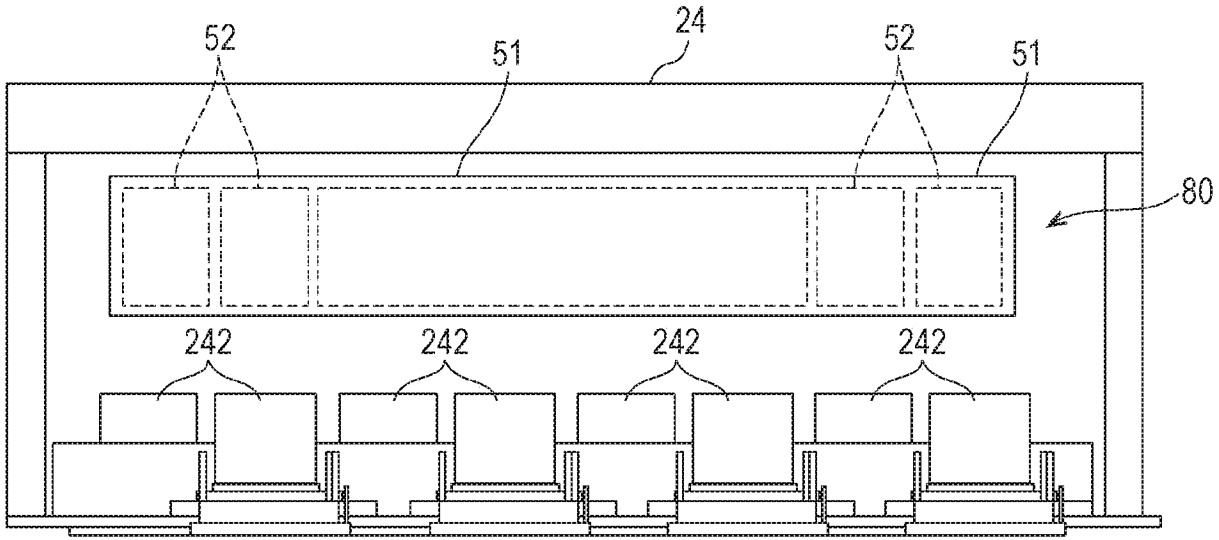
FIGS. 2A and 2B are diagrams illustrating a configuration of a head unit.
Figure 2B:
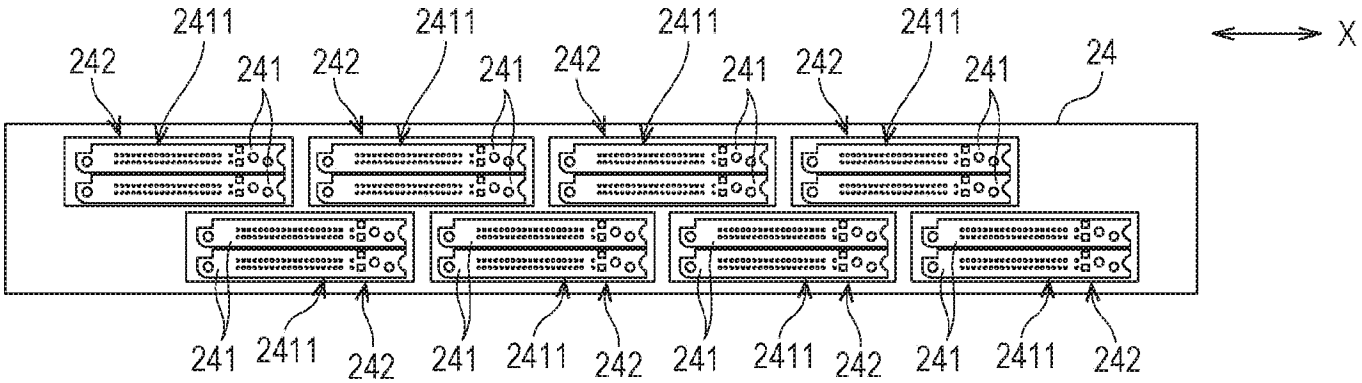

Note that the head unit 24 according to the present embodiment has a length (width) that covers the entire recording medium M in a direction (width direction) perpendicular to the conveyance direction of the recording medium M. In other words, the inkjet recording apparatus 1 is a line-head inkjet recording apparatus of a one-pass system. The head unit 24 is capable of forming a line head by arranging a plurality of inkjet heads 241 (FIGS. 2A and 2B). An internal configuration of the head unit 24 will be described later.

After the ink used in the inkjet recording apparatus 1 according to the present embodiment is ejected onto the recording medium M, the irradiator 25 emits an energy ray for curing the ink. The irradiator 25 includes a fluorescent tube such as a low pressure mercury lamp, for example, and emits an energy ray such as an ultraviolet ray by causing the fluorescent tube to emit light. The irradiator 25 is provided in the vicinity of the outer peripheral surface of the image forming drum 21, which is on the downstream side of the head units 24 with respect to the conveyance direction of the recording medium M based on the rotation of the image forming drum 21. The irradiator 25 irradiates, with an energy ray, the recording medium M supported by the image forming drum 21 and on which the ink is ejected, thereby curing the ink ejected onto the recording medium M on the basis of the action of the energy ray.

Examples of the fluorescent tube include, in addition to the low pressure mercury lamp, a mercury lamp having an operation pressure of about several hundred Pa to 1 MPa, a light source that can be used as a germicidal lamp, a cold-cathode tube, an ultraviolet laser light source, a metal halide lamp, and a light-emitting diode. It is more preferable to employ a light source capable of emitting ultraviolet rays with higher illuminance and consuming less power (e.g., light-emitting diode) among them. Further, the energy ray is not limited to the ultraviolet ray, and may be any energy ray having the property of curing ink according to the property of the ink, and the light source may be replaced depending on the wavelength of the energy ray or the like.

The delivery unit 26 conveys the recording medium M irradiated with the energy ray by the irradiator 25 from the image forming drum 21 to the sheet ejector 30. The delivery unit 26 includes a plurality of (two, in this case) rollers 261 and 262, an annular belt 263, and the like. The belt 263 is rotationally driven by the plurality of rollers 261 and 262. The delivery unit 26 includes a conveyance mechanism for conveying the recording medium M on the belt 263, and a cylindrical delivery drum 264 for delivering the recording medium M from the image forming drum 21 to the conveyance mechanism. The delivery unit 26 conveys, using the belt 263, the recording medium M delivered to the belt 263 by the delivery drum 264, and delivers it to the sheet ejector 30.

The sheet ejector 30 stores the recording medium M delivered from the image former 20 by the delivery unit 26. The sheet ejector 30 includes a tabular sheet ejection tray 31 and the like, and places the recording medium M having been subject to the image formation on the sheet ejection tray 31.

The controller 40 controls operation of each unit of the inkjet recording apparatus 1, and performs centralized control on the entire operation. The controller 40 includes a central processing unit (CPU) 41 (FIG. 6), a read-only memory (ROM), a random access memory (RAM), and the like. The controller 40 reads out various processing programs, such as a system program, stored in the ROM, loads them in the RAM, and causes the CPU 41 to execute the programs loaded in the RAM.

The ink used in the inkjet recording apparatus 1 includes, for example, a UV ink. The UV ink undergoes, in the state of not being irradiated with the UV, a change of phase between the gel state and the liquid (sol) state depending on the temperature. The UV ink has a phase change temperature of, for example, about 100° C., and is uniformly liquefied (subject to solation) when heated to a temperature equal to or higher than the phase change temperature. Meanwhile, this ink gelates at a temperature equal to or lower than the phase change temperature including normal ambient temperature (0° C. to 30° C.).

Next, a configuration of one head unit 24 out of the plurality of head units 24 will be described.

FIGS. 2A and 2B are diagrams illustrating the configuration of the head unit 24. FIG. 2A is a front view, and FIG. 2B is a bottom view. Note that, in the drawing, the longitudinal direction of the head unit 24 is regarded as an X direction, the direction along the ink ejection direction of the head unit 24 provided with the ink heater 80 is regarded as a Z direction, and the direction orthogonal to the X direction and the Z direction is regarded as a Y direction.

Referring to FIGS. 2A and 2B, the head unit 24 includes the plurality of inkjet heads 241, and the ink heater 80. Here, one head unit 24 includes 16 inkjet heads 241. The 16 inkjet heads 241 constitutes eight inkjet modules 242 with each two inkjet heads 241 being paired.

Referring to FIG. 2B, each of the inkjet heads 241 includes a plurality of nozzles 2411. When one inkjet head 241 is focused, the plurality of nozzles 2411 is exposed on the lower surface side of the head unit 24, and is configured by two rows extending in the X direction. The inkjet head 241 ejects ink from the plurality of nozzles 2411 to form an image on the recording medium M supported by the image forming drum 21.

As illustrated in FIG. 2B, the eight inkjet modules 242 are configured in two rows extending in the X direction. Each of the eight inkjet modules 242 is disposed zigzag in the two rows with respect to the direction orthogonal to the X direction.

As described above, in order to stabilize the fluidity of the ink in an ink tank 50 and the ink ejection amount in the head, the ink heater 80 heats the ink so that the ink in the gel state at about the ambient temperature enters the liquid (sol) state, and supplies the heated ink to each of the plurality of inkjet heads 241.

Figure 3:
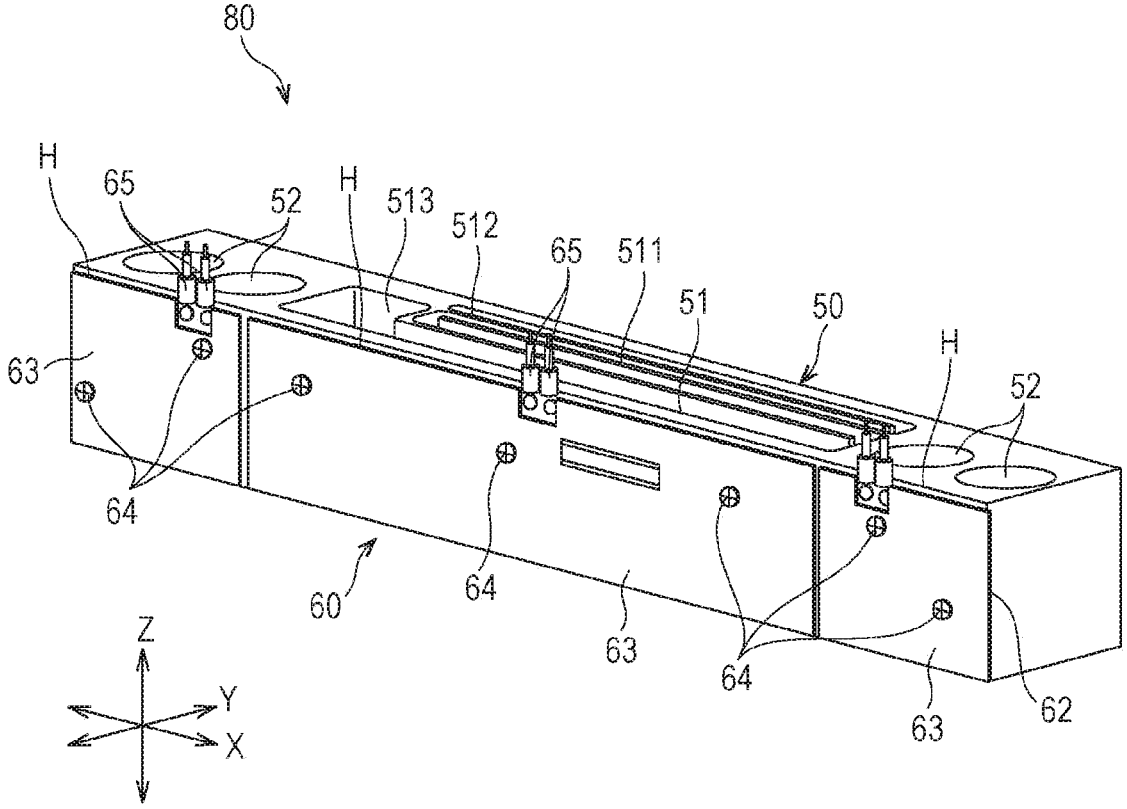
FIG. 3 is a perspective view illustrating a configuration of an ink heater, which is a perspective view viewed from one direction.
Figure 4:
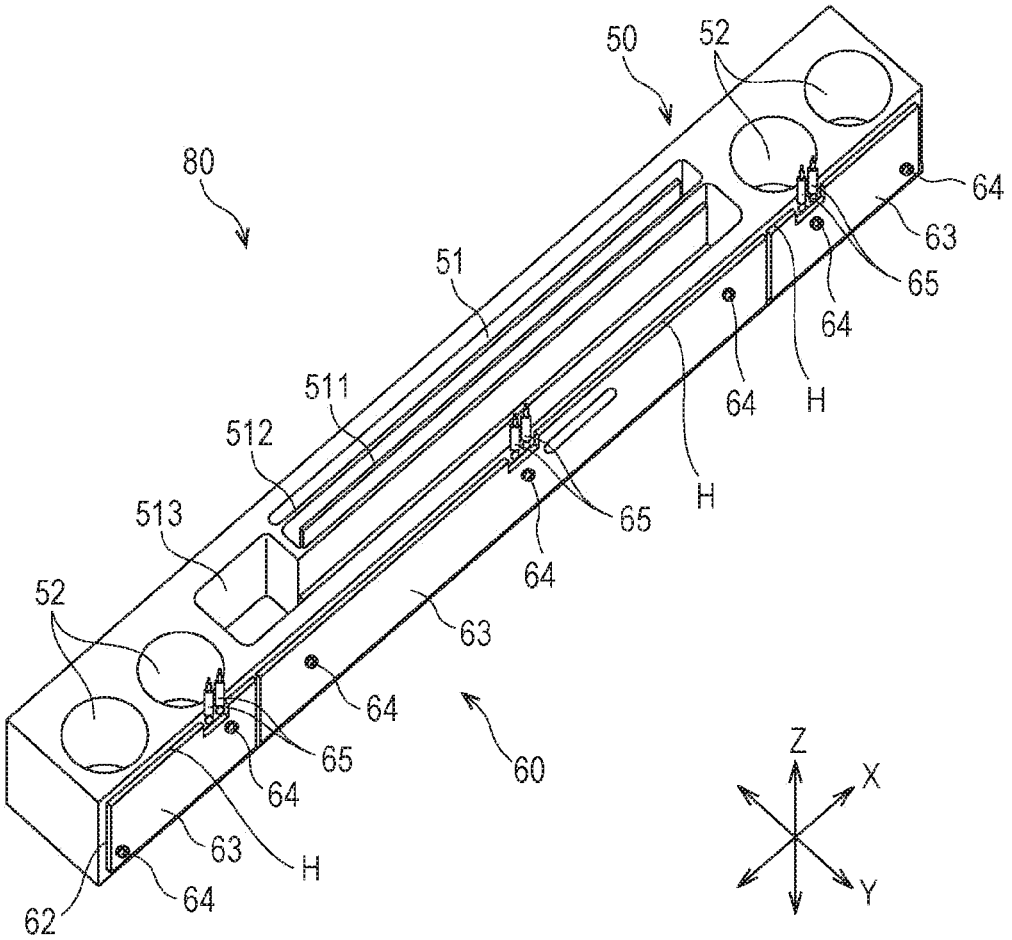
FIG. 4 is a perspective view illustrating the configuration of the ink heater, which is a perspective view viewed from another direction.

FIGS. 3 and 4 are perspective views illustrating a configuration of the ink heater 80. FIG. 3 is a perspective view viewed from one direction, and FIG. 4 is a perspective view viewed from another direction different from one direction.

Referring to FIGS. 3 and 4, the ink heater 80 includes the ink tank 50 (exemplary ink holder), and an ink tank heater 60. The ink tank 50 is formed in such a manner that a plurality of sub tanks for storing ink is arranged in the longitudinal direction and is integrally molded. The ink tank heater 60 is provided on the outer surface of the ink tank 50. The ink tank heater 60 heats the ink tank 50.

The ink tank 50 stores ink supplied from an ink storage unit (not illustrated), and supplies the stored ink to the inkjet head 241. Further, the ink tank 50 collects and stores the ink that has not been ejected from the inkjet head 241. The ink tank 50 is formed to be long in the X direction, and includes a first sub tank 51 and four second sub tanks 52 integrally molded. The first sub tank 51 and the second sub tank 52 are arranged along the longitudinal direction (X direction) of the ink tank 50.

The first sub tank 51 is provided in a recessed manner at the center of the ink tank 50 in the longitudinal direction (X direction). The first sub tank 51 stores the ink supplied from an ink supply unit (not illustrated), and also stores the ink collected from the inkjet head 241.

The first sub tank 51 includes a flow path 511, an inflow portion 512, and a reservoir 513. The flow path 511 is for causing the supplied ink to flow. The inflow portion 512 is provided at one end of the flow path 511. The inflow portion 512 is a portion into which the ink supplied or collected from the ink supply unit or the inkjet head 241 flows. The reservoir 513 is provided at the other end of the flow path 511. The reservoir 513 is a portion that stores the ink having passed through the flow path 511 and supplies the ink to the second sub tank 52.

In other words, the ink supplied from the inflow portion 512 passes through the flow path 511, and is stored in the reservoir 513. The ink that has reached the reservoir 513 is delivered to the plurality of second sub tanks 52 by a plurality of pumps (not illustrated).

The second sub tanks 52 are provided two by two on both ends of the ink tank 50 in the longitudinal direction (X direction) in a recessed manner. The second sub tank 52 stores the ink supplied from the first sub tank 51. The ink stored in each of the second sub tanks 52 is supplied to each of the eight inkjet modules 242 provided in the head unit 24.

The ink tank heater 60 covers the entire one side surface of the ink tank 50. The ink tank heater 60 includes a sheet heater H (exemplary planar heat generator), an elastic member 62, a metallic plate 63, a fixing screw 64, and a thermistor 65. The sheet heater H is provided on the outer surface of the ink tank 50, and heats the ink tank 50. The elastic member 62 is sandwiched between the sheet heater H and the metallic plate 63. The metallic plate 63 is tabular, and is provided on the surface of the sheet heater H on the side opposite to the side facing the ink tank 50. The fixing screw 64 presses and fixes the metallic plate 63 to the side of the ink tank 50. The thermistor 65 is in contact with the sheet heater H.

The sheet heater H, the elastic member 62, the metallic plate 63, the fixing screw 64, and the thermistor 65 are separately provided at three portions of the center and the both ends of the ink tank 50 in the longitudinal direction. The sheet heater H and the like separately provided in the three portions are disposed at positions corresponding to the first sub tank 51 provided at the center of the ink tank 50 in the longitudinal direction (X direction) and the second sub tanks 52 provided at the both ends of the ink tank 50 in the longitudinal direction (X direction), respectively.

Note that the inkjet recording apparatus 1 includes the head units 24 corresponding to the colors of Y, M, C, and K, and each of the plurality of head units 24 includes the ink tank 50. Therefore, the inkjet recording apparatus 1 includes a plurality of ink tanks 50 for holding each of the inks of a plurality of different colors (each of the colors Y, M, C, and K).

Figure 5:
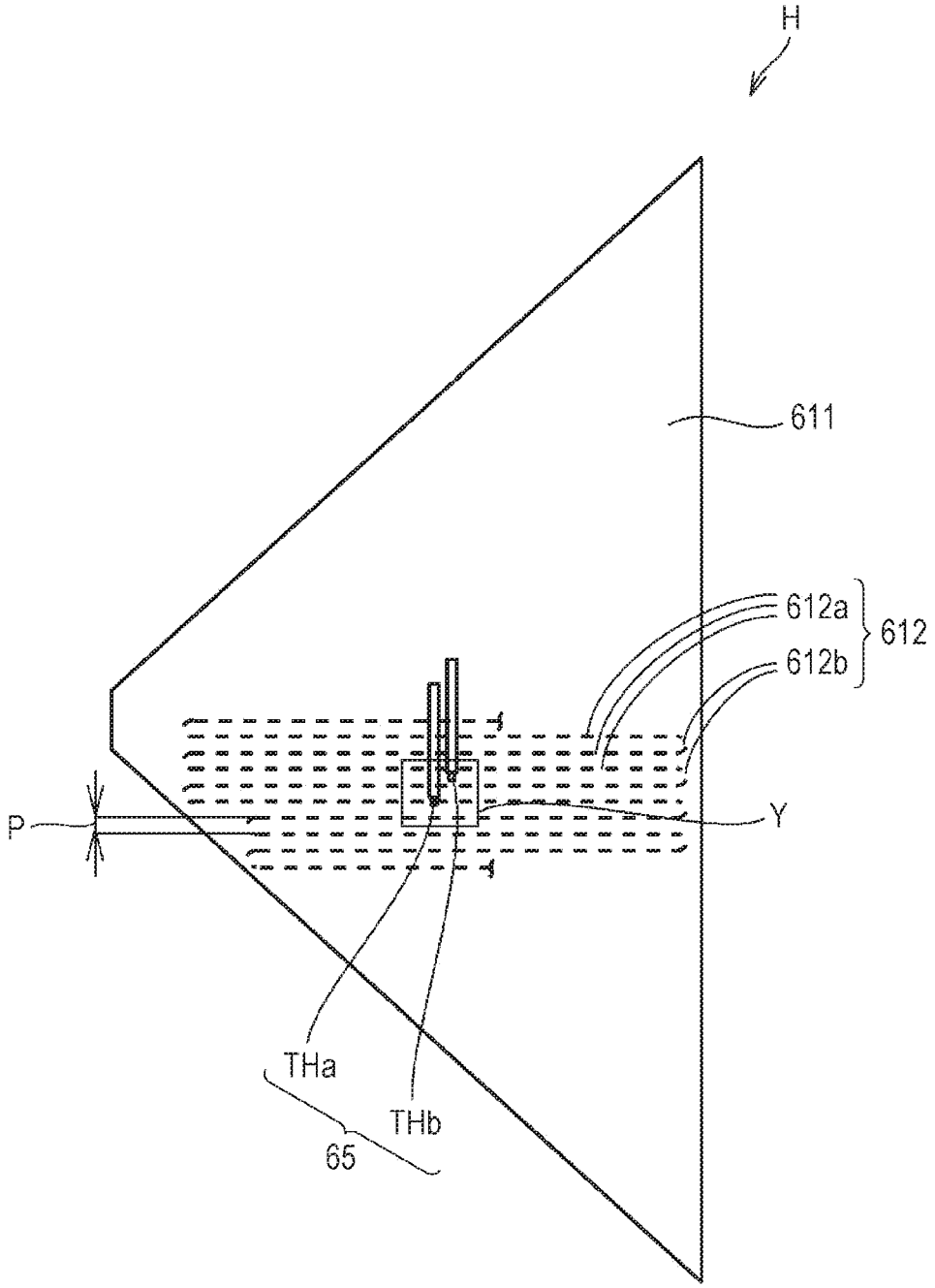
FIG. 5 is a plan view illustrating a configuration of a sheet heater and a thermistor.

FIG. 5 is a plan view illustrating a configuration of the sheet heater H and the thermistor 65. Note that only a part of a heat generator 612 is illustrated in FIG. 5.

Referring to FIG. 5, the sheet heater H includes an insulator 611 (exemplary insulator), and the heat generator 612 (exemplary heat generator). The insulator 611 includes a rubber sheet made of silicone or the like. The insulator 611 has an arbitrary planar shape, and in this case, it has a planar shape that is substantially triangular.

The heat generator 612 is provided in the insulator 611, and is embedded in the entire insulator 611. The heat generator 612 is disposed in the insulator 611 in a corrugated manner, and has a meandering planar shape. The heat generator 612 includes a nichrome wire or stainless steel (SUS thin film formed by etching), or the like. The heat generator 612 includes a plurality of linear parts 612*a* (exemplary linear part), and a plurality of connection end parts 612*b*. Each of the plurality of linear parts 612*a* extends in parallel with each other at a predetermined interval P to obtain target power density per unit area. Each of the plurality of connection end parts 612*b* has an arc shape, and connects two adjacent linear parts 612*a* at the end of the linear part 612*a*.

The thermistor 65 includes thermistors THa and THb (exemplary temperature sensor). The thermistors THa and THb are of contact-type, and are provided at predetermined positions on the sheet heater H. The thermistors THa and THb function as a plurality of temperature sensors that measures a surface temperature of the sheet heater H. Note that a thermocouple may be used as a temperature sensor instead of the thermistor.

The controller 40 performs thermostatic control on the sheet heater H such that the temperature measured by the thermistor 65 becomes a target value Ti in a predetermined condition (in this case, condition in which the sheet heater H shifts to an idling mode).

The thermistors THa and THb are provided close to each other in pairs for one sheet heater H. One of the thermistors THa and THb is a thermistor for thermostatic control. That is, in a predetermined condition, the controller 40 maintains the temperature measured by the thermistor for thermostatic control at a predetermined target value Ti.

The other one of the thermistors THa and THb is a thermistor for abnormality detection (for safety protection in an emergency). That is, the controller 40 monitors the difference between the temperature measured by the thermistor for abnormality detection and the temperature measured by the thermistor for thermostatic control, and determines that the thermistor is abnormal when the difference in temperature becomes equal to or more than a threshold value. The abnormality of the thermistor assumed in this case is an error in attachment of the thermistor, a mixture of foreign matter between the heater and the contact, a manufacturing failure of the thermistor itself, or the like.

Figure 6:
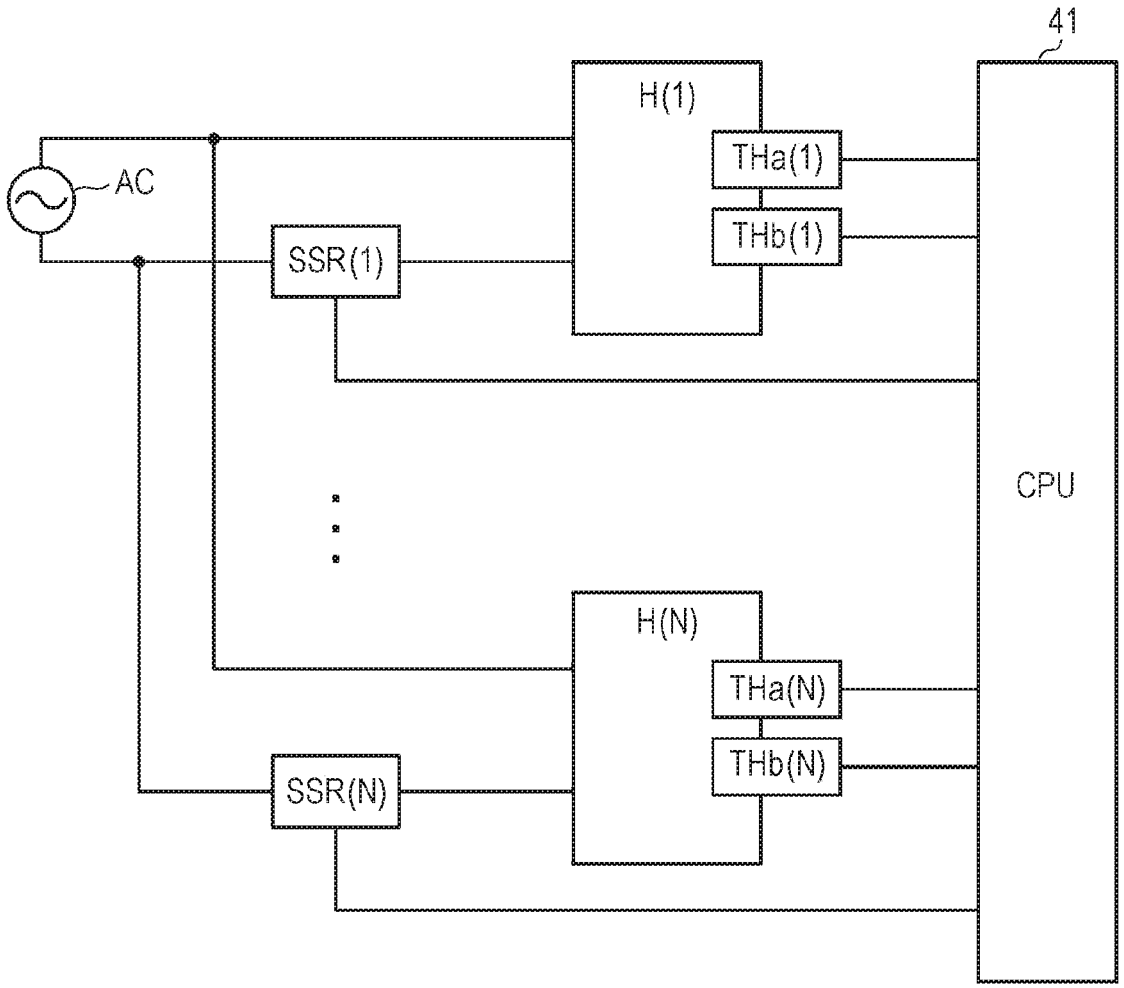
FIG. 6 is a diagram illustrating a control circuit of the sheet heater in the inkjet recording apparatus.

FIG. 6 is a diagram illustrating a control circuit of the sheet heater H in the inkjet recording apparatus 1.

Referring to FIG. 6, the inkjet recording apparatus 1 further includes a plurality of thyristors SSR (exemplary power supply circuit). Each of the plurality of thyristors SSR is connected between an alternating-current power supply AC and each of the plurality of sheet heaters H, and controls the supply of power to each of the plurality of sheet heaters H.

Here, the inkjet recording apparatus 1 includes N (N is a natural number) sheet heaters H. Each of the N sheet heaters H is denoted by a sheet heater H(1), a sheet heater H(2), a sheet heater H(3), and so on, and a sheet heater H(N). In addition, the thermistors THa and THb corresponding to each of the sheet heaters H(1) to H(N) are denoted by thermistors THa(1) and THb(1), thermistors THa(2) and THb(2), thermistors THa(3) and THb(3), and so on, and thermistors THa(N) and THb(N), respectively. Furthermore, the thyristors SSR corresponding to the respective sheet heaters H(1) to H(N) are denoted by a thyristor SSR(1), a thyristor SSR(2), a thyristor SSR(3), and so on, and a thyristor SSR (N), respectively.

Here, one sheet heater H(1) is focused. The CPU 41 of the controller 40 controls, in a predetermined condition, on/off of the thyristor SSR(1) using a heater remote signal, thereby controlling energization of the heat generator 612 of the sheet heater H(1) using the thyristor SSR(1). As a result, the CPU 41 maintains the temperature measured by the thermistor for thermostatic control among the thermistors THa(1) and THb(1) at the target value Ti.

Note that, as illustrated in FIG. 1, the inkjet recording apparatus 1 according to the present embodiment includes four head units 24 corresponding to the respective colors Y, M, C, and K. As illustrated in FIG. 2B, one head unit 24 includes one ink tank 50. As illustrated in FIGS. 3 and 4, one ink tank 50 includes three sheet heaters H. One sheet heater H includes one thyristor SSR, and two thermistors THa and THb. Therefore, the value of N in the present embodiment is 12(=4×1×3). The value of N may be one, or two or more.

Referring to FIG. 5, the thermistors THa and THb are attached to the sheet heater H having been complete at predetermined positions determined on the basis of dimensions of the sheet heater H. However, the position of the heat generator 612 varies among the products of the sheet heater H.

Moreover, since the heat generator 612 is provided inside the insulator 611 at the time of attaching the thermistors THa and THb, it is difficult to visually confirm the position of the heat generator 612 from the surface (surface appearance) of the sheet heater H. For that reason, the positions at which the thermistors THa and THb are attached vary among the products of the sheet heater H. As a result, there are variations among the products of the sheet heater H in the relationship between the positions of the thermistors THa and THb and the position of the heat generator 612.

Positional Relationship Between Two Thermistors and Heat Generator

Figure 7B:
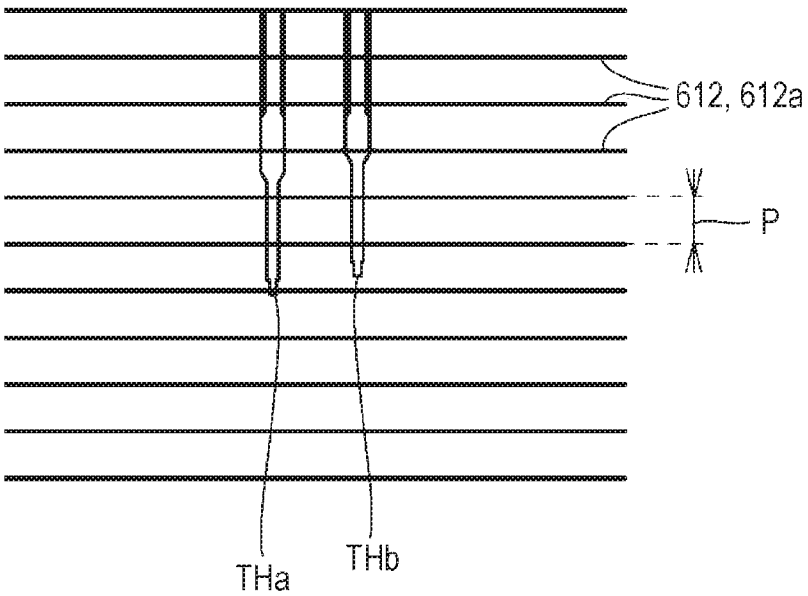
FIGS. 7A and 7B are diagrams illustrating a positional relationship between thermistors THa and THb and a heat generator according to an embodiment of the present invention.
Figure 7A:
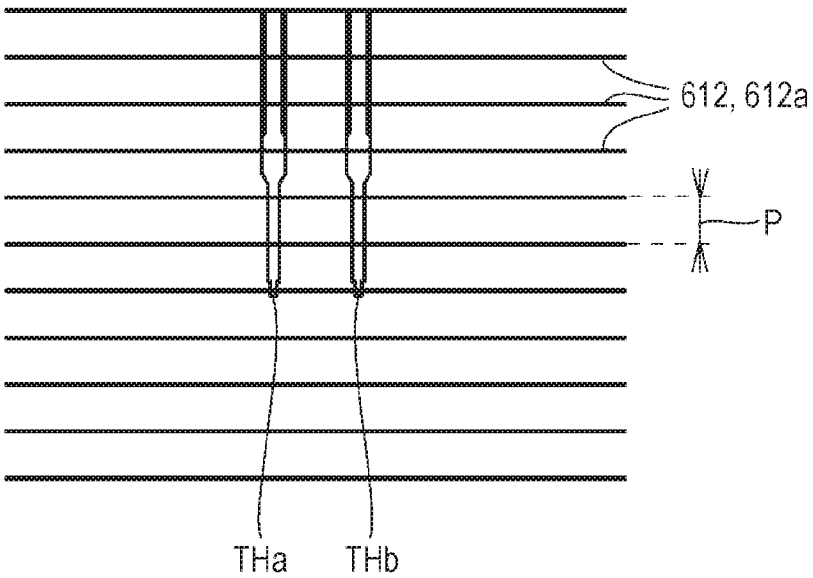

FIGS. 7A and 7B are diagrams illustrating a positional relationship between thermistors THa and THb and the heat generator 612 according to an embodiment of the present invention, which are enlarged views of a portion Y in FIG. 5. FIG. 7A is an example of a case C1, and FIG. 7B is an example of a case C2.

Referring to FIG. 7A, as described above, there are variations among the products of the sheet heater in the relationship between the positions of the two thermistors and the position of the heat generator. Even if the sheet heater H has the same specifications, both of the two thermistors THa and THb may be disposed on the linear part 612*a* of the heat generator 612 as in the case C1 illustrated in FIG. 7A, or the thermistor THa, which is one of the two thermistors THa and THb, may be disposed on the linear part 612*a* and the other thermistor THb may be disposed between the two linear parts 612*a* as in the case C2 illustrated in FIG. 7B. Moreover, although illustration is omitted, both of the two thermistors THa and THb may be disposed between the two linear parts 612*a*.

The present inventors conducted the following experiments to confirm the problems of abnormality detection of the thermistor in the conventional manner.

Figure 8A:
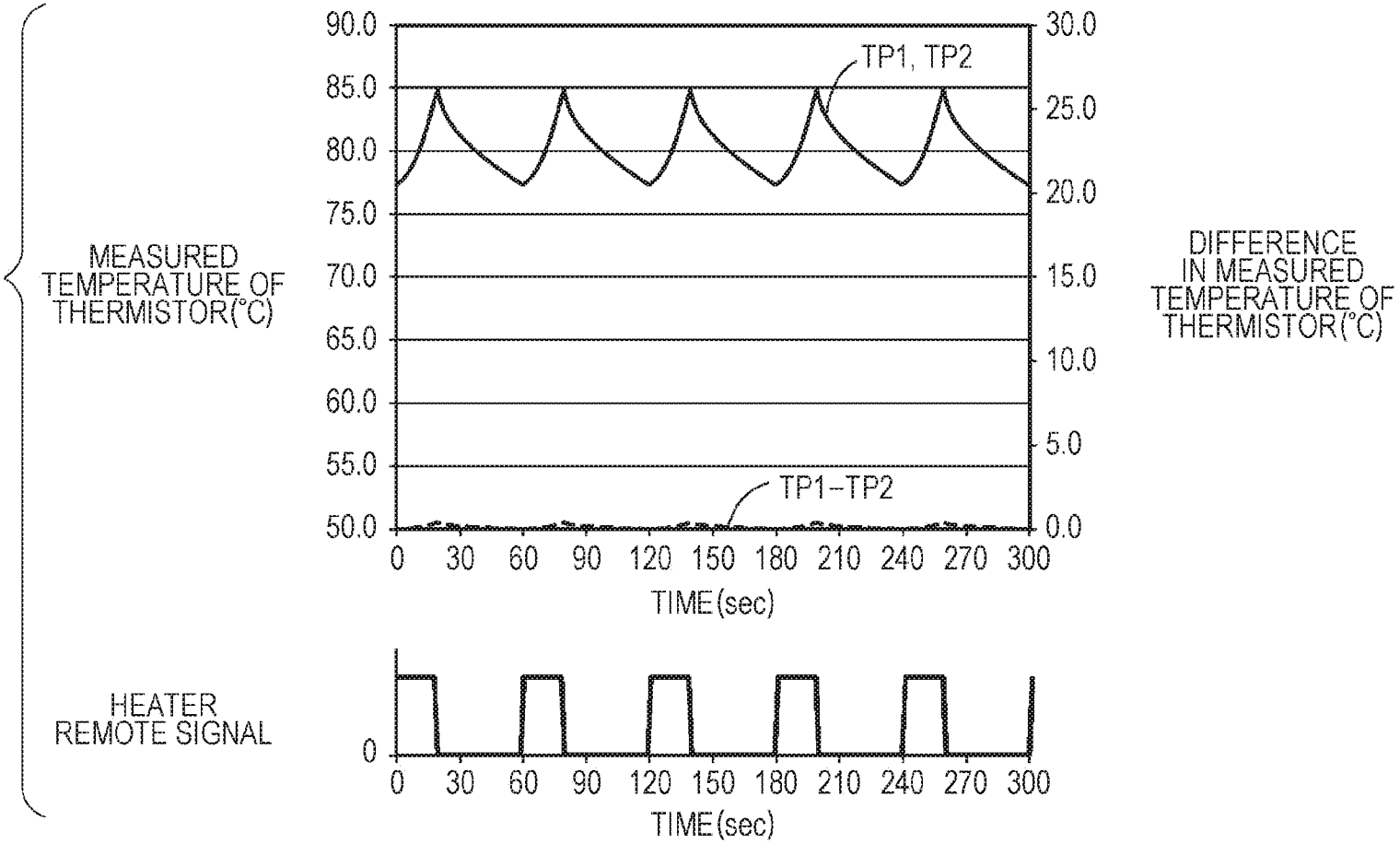
FIGS. 8A and 8B are graphs schematically illustrating a temporal change of a difference in temperature between a measured temperature TP1 of the thermistor THa and a measured temperature TP2 of the thermistor THb in a case C1.
Figure 8B:
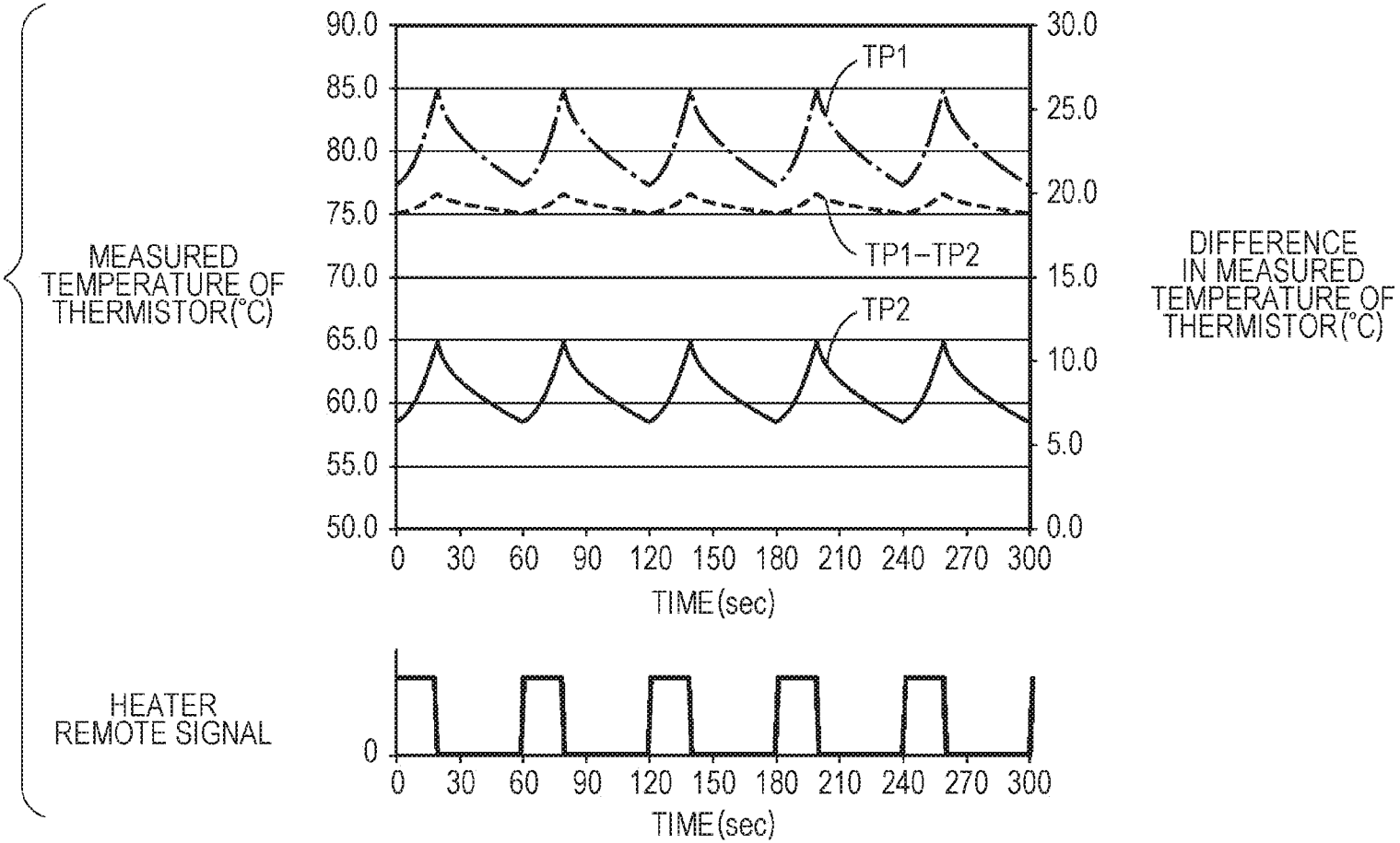

FIGS. 8A and 8B are graphs schematically illustrating a temporal change of a difference in temperature between a measured temperature TP1 of the thermistor THa and a measured temperature TP2 of the thermistor THb in the case C1. FIG. 8A illustrates a case where the thermistors THa and THb are normal, and FIG. 8B illustrates a case where the thermistor THa is normal and the thermistor THb is abnormal. Note that, in FIGS. 8A and 8B and FIGS. 9A and 9B, the thermistor THa is set to be the thermistor for thermostatic control, and supply of power to the sheet heater H is controlled such that the temperature measured by the thermistor THa becomes about 85° C. (=target value Ti).

Referring to FIGS. 8A and 8B, in the case C1 (FIG. 7A), when the thermistors THa and THb were normal (FIG. 8A), there was substantially no difference between the measured temperature TP1 of the thermistor THa and the measured temperature TP2 of the thermistor THb. When the thermistor THa was normal and the thermistor THb was abnormal (FIG. 8B), a difference in temperature of about 20° C. was generated between the measured temperature TP1 of the thermistor THa and the measured temperature TP2 of the thermistor THb.

Figure 9A:
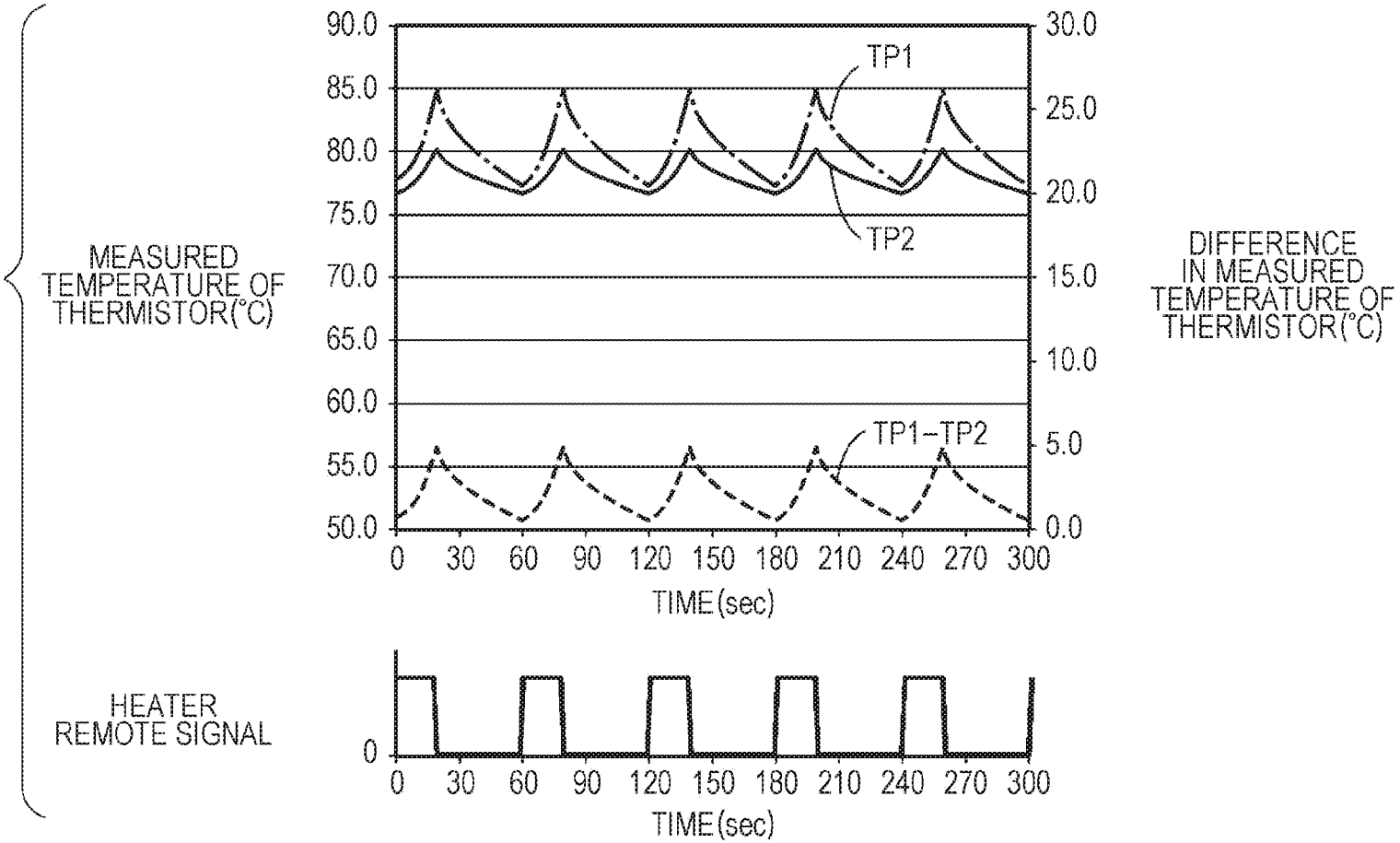
FIGS. 9A and 9B are graphs schematically illustrating a temporal change of a difference in temperature between the measured temperature TP1 of the thermistor THa and the measured temperature TP2 of the thermistor THb in a case C2.
Figure 9B:
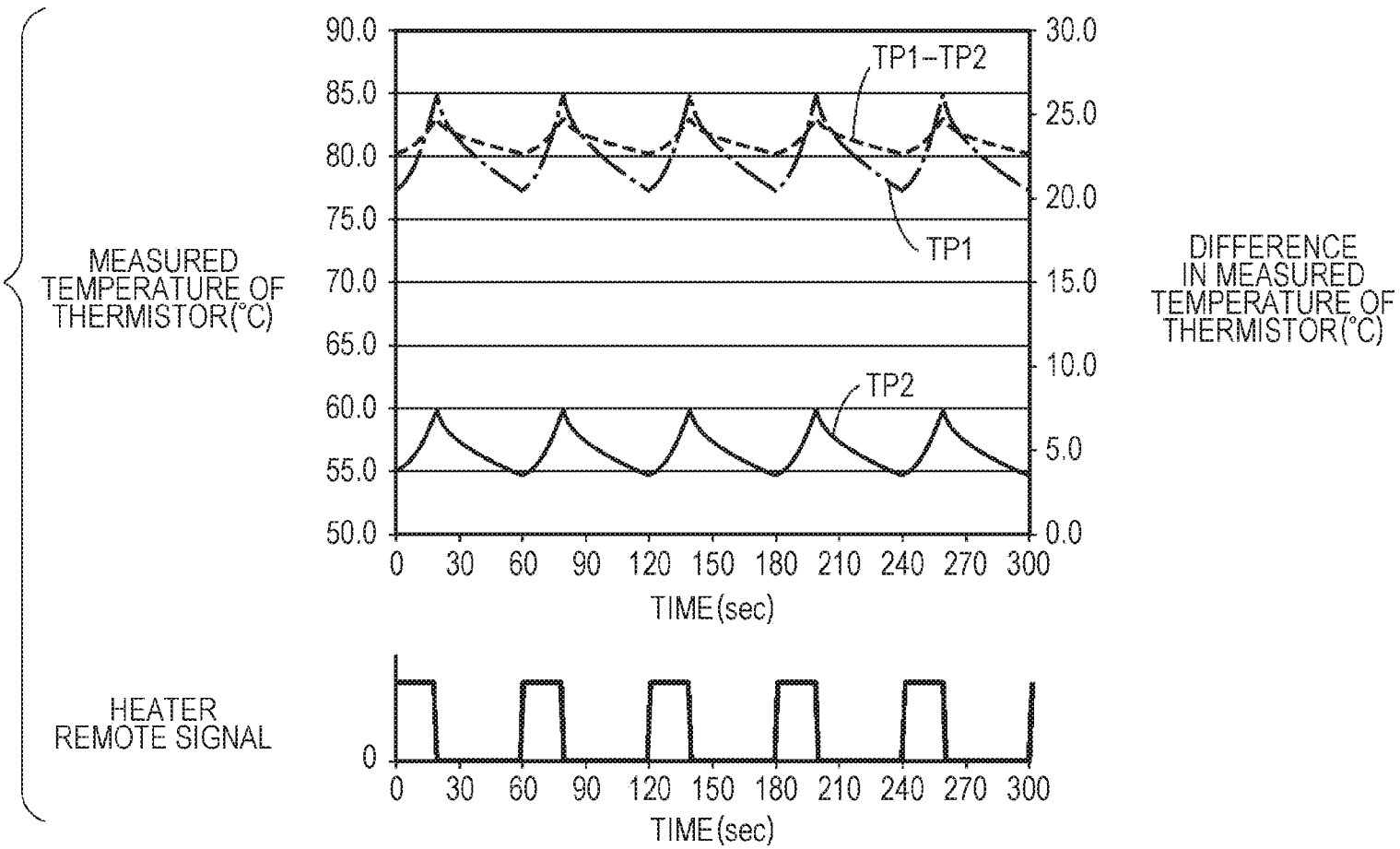

FIGS. 9A and 9B are graphs schematically illustrating a temporal change of the difference in temperature between the measured temperature TP1 of the thermistor THa and the measured temperature TP2 of the thermistor THb in the case C2. FIG. 9A illustrates a case where the thermistors THa and THb are normal, and FIG. 9B illustrates a case where the thermistor THa is normal and the thermistor THb is abnormal.

Referring to FIGS. 9A and 9B, in the case C2 (FIG. 7B), when the thermistors THa and THb were normal (FIG. 9A), a difference in temperature of about 5° C. was generated between the measured temperature TP1 of the thermistor THa and the measured temperature TP2 of the thermistor THb. When the thermistor THa was normal and the thermistor THb was abnormal (FIG. 9B), a difference in temperature of about 25° C. was generated between the measured temperature TP1 of the thermistor THa and the measured temperature TP2 of the thermistor THb.

FIG. 10 is a table illustrating a result of abnormality detection of the thermistor in the conventional manner.

Referring to FIG. 10, conventionally, the thermistor is determined to be abnormal in the case where an absolute value ΔT of the difference in temperature between the measured temperature TP1 of the thermistor THa and the measured temperature TP2 of the thermistor THb (=|TP1−TP2|) exceeds a predetermined threshold value (in this case, 5° C.). Particularly when the state of the UV ink continues to exceed 100° C., the ink deteriorates to generate precipitations, thereby causing a problem such as clogging of an ink flow path. In view of the above, a condition for abnormality determination of the thermistor is strictly set such that the period of time during which the temperature of the ink exceeds 100° C. is minimized (threshold value is set to be a small value) even when abnormality occurs in the thermistor.

As illustrated in FIGS. 8A and 8B, in the case C1, there is substantially no difference between the measured temperature TP1 of the thermistor THa and the measured temperature TP2 of the thermistor THb when the thermistors THa and THb are normal. As a result, the absolute value ΔT of the difference in temperature is less than the predetermined threshold value, whereby the thermistor is determined to be normal. Further, when one of the thermistors (in this case, thermistor THb) is abnormal, the difference in temperature of about 20° C. is generated between the measured temperature TP1 of the thermistor THa and the measured temperature TP2 of the thermistor THb. As a result, the absolute value ΔT of the difference in temperature is larger than the predetermined threshold value, whereby the thermistor is determined to be abnormal.

As illustrated in FIGS. 9A and 9B, in the case C2, the difference in temperature of about 5° C. is generated between the measured temperature TP1 of the thermistor THa and the measured temperature TP2 of the thermistor THb even when the thermistors THa and THb are normal. This difference in temperature is caused by the difference in temperature between the position at which the thermistor THa is provided and the position at which the thermistor THb is provided. As a result, the absolute value ΔT of the difference in temperature becomes larger than the predetermined threshold value, whereby the thermistor is erroneously determined to be abnormal. Furthermore, when one of the thermistors (in this case, thermistor THb) is abnormal, the difference in temperature of about 25° C. is generated between the measured temperature TP1 of the thermistor THa and the measured temperature TP2 of the thermistor THb. As a result, the absolute value ΔT of the difference in temperature is larger than the predetermined threshold value, whereby the thermistor is determined to be abnormal.

Flowchart

In order to enhance the accuracy in detecting abnormality of the thermistor, in the present embodiment, the controller 40 detects abnormality in the case where the difference in temperature measured by each of the thermistors THa and THb exceeds an abnormality threshold value T1 after a predetermined waiting time WT has elapsed since the stop of power supply to the sheet heater H. This operation will be described using the following flowchart.

Figure 11:
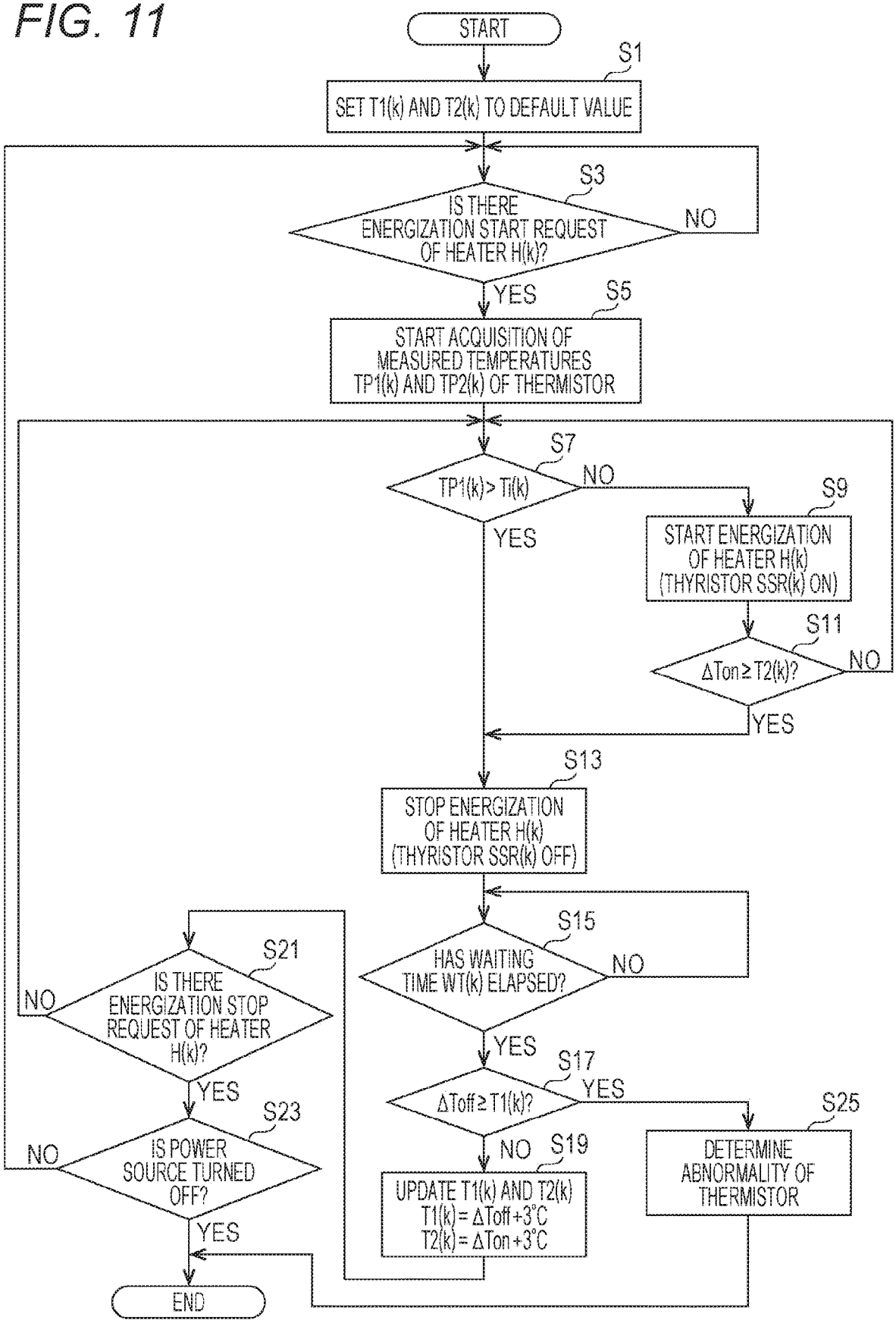
FIG. 11 is a flowchart illustrating operation of an inkjet recording apparatus according to an embodiment of the present invention.

FIG. 11 is a flowchart illustrating operation of the inkjet recording apparatus 1 according to an embodiment of the present invention.

Note that a process indicated by this flowchart is performed in parallel for each of the N sheet heaters H(1) to H(N). In this flowchart, any optional sheet heater H among the N sheet heaters H(1) to H(N) is denoted by a sheet heater H(k) (k is any natural number of 1 to N). In addition, the thermistors THa and THb for measuring the temperature of the sheet heater H(k) are denoted by thermistors THa(k) and THb(k), respectively. The measured temperatures TP1 and TP2 of the thermistors THa(k) and THb(k) are denoted by TP1(k) and TP2(k), respectively. The thyristor SSR that controls energization of the sheet heater H(k) is denoted by a thyristor SSR(k). The target value Ti of the measured temperature of the thermistor for thermostatic control of the sheet heater H(k) is denoted by a value Ti(k). The abnormality threshold value T1 and a stop threshold value T2 of the sheet heater H(k) are denoted by an abnormality threshold value T1(k) and a stop threshold value T2(k), respectively. The waiting time WT set for the sheet heater H(k) is denoted by a waiting time WT(k). Moreover, in this flowchart, the thermistor THa is assumed to be the thermistor for thermostatic control, and the thermistor THb is assumed to be the thermistor for abnormality detection. The target value Ti and the waiting time WT to be described later may be different values for each of the N sheet heaters H, or may be the same value.

Referring to FIG. 11, when the power source of the inkjet recording apparatus 1 is turned on, the controller 40 sets each of the abnormality threshold value T1(k) and the stop threshold value T2(k) to a default value (Si). The default value of each of the abnormality threshold value T1(k) and the stop threshold value T2(k) is, for example, 5° C. Next, the controller 40 determines whether an energization start request of the sheet heater H(k) is received (S3). The controller 40 receives the energization start request when it is necessary to heat the sheet heater H(k), such as at the time of starting printing. The controller 40 repeats the processing of step S3 until it determines that the energization start request of the sheet heater H(k) is received.

When the energization start request of the sheet heater H(k) is received in step S3 (YES in S3), the controller 40 shifts to a warm-up mode, starts energization control of the sheet heater H(k), and starts acquisition of the measured temperature TP1(k) of the thermistor THa(k) and the measured temperature TP2(k) of the thermistor THb (S5). Next, the controller 40 determines whether the measured temperature TP1(k) of the thermistor THa(k) exceeds the target value Ti(k) (S7).

When it is determined that the measured temperature TP1(k) of the thermistor THa(k) exceeds the target value Ti in step S7 (YES in S7), the controller 40 determines that the sheet heater H(k) has reached the target value and shifts to the idling mode. In this case, the controller 40 turns off the thyristor SSR(k) to stop the energization of the sheet heater H(k) (S13).

When it is determined that the measured temperature TP1(k) of the thermistor THa(k) does not exceed the target value Ti in step S7 (NO in S7), the controller 40 turns on the thyristor SSR(k) to start (or continue) the energization of the sheet heater H(k) (supply of power to the sheet heater H(k)) (S9). Next, the controller 40 determines whether a difference in temperature Δton is equal to or higher than the stop threshold value T2(k) (S11). The difference in temperature ΔTon corresponds to the absolute value ΔT (=|TP1(k)−TP2(k)|) of the difference in temperature between the measured temperature TP1(k) of the thermistor THa(k) and the measured temperature TP2(k) of the thermistor THb(k) at the time when the sheet heater H(k) is energized.

When it is determined that the difference in temperature ΔTon is not equal to or higher than the stop threshold value T2(k) in step S11 (NO in S11), the controller 40 determines that there is no suspected abnormality of the thermistor, and proceeds to the processing of step S7.

When it is determined that the difference in temperature ΔTon is equal to or higher than the stop threshold value T2(k) in step S11 (YES in S11), the controller 40 determines that there is suspected abnormality of the thermistor. In this case, the controller 40 proceeds to the processing of step S13, and stops the energization of the sheet heater H(k) (S13).

Subsequent to step S13, the controller 40 determines whether the waiting time WT(k) has elapsed since the stop of the energization of the sheet heater H(k) (S15). The controller 40 repeats the processing of step S15 until it determines that the waiting time WT(k) has elapsed since the stop of the energization of the sheet heater H(k).

When it is determined that the waiting time WT(k) has elapsed since the stop of the energization of the sheet heater H(k) in step S15 (YES in S15), the controller 40 obtains the measured temperatures TP1(k) and TP2(k) of the thermistors THa(k) and THb(k), and determines whether a difference in temperature ΔToff is equal to or higher than the abnormality threshold value T1(k) (S17). The difference in temperature ΔToff corresponds to the absolute value ΔT (=|TP1(k)−TP2(k)|) of the difference in temperature between the measured temperature TP1(k) of the thermistor THa(k) and the measured temperature TP2(k) of the thermistor THb(k) at the time when the sheet heater H(k) is de-energized.

Here, there are the following reasons for performing the determination processing of step S15 on the basis of the difference in temperature ΔToff after the waiting time WT(k) has elapsed. In general, in a planar heat generator such as a sheet heater, while a temperature is high at a position near a heat generator when it is energized, a temperature is low at a position between linear parts, which results in large unevenness in temperature in the surface. Accordingly, in the case where the difference in temperature between the positions at which the two thermistors THa and THb are disposed is originally large as in the case C2 (FIG. 7B), even if the thermistors THa and THb are normal, the difference in temperature ΔTon between the measured temperature TP1 of the thermistor THa and the measured temperature TP2 of the thermistor THb at the time of energization may become large, and may exceed the stop threshold value T2.

On the other hand, when the energization of the planar heat generator stops, the temperature in the vicinity of the heat generator decreases as time elapses, and the unevenness in temperature in the surface decreases (temperature of the planar heat generator is equalized). Accordingly, even in the case C2, when the thermistors THa and THb are normal, the difference in temperature ΔToff at the time of energization between the measured temperature TP1 of the thermistor THa and the measured temperature TP2 of the thermistor THb after the waiting time WT has elapsed decreases, and falls below the abnormality threshold value T1.

Note that the waiting time WT may be set to a fixed value determined on the basis of the maximum flow rate of the ink flowing through the ink tank 50 provided with the sheet heater H. Moreover, the controller 40 may calculate (obtain) the flow rate of the ink on the basis of the content (printing rate, etc.) of a print job executed by the inkjet recording apparatus 1, and may set the waiting time WT according to the calculated flow rate of the ink. In either case, the waiting time WT is preferably set to be shorter as the flow rate of the ink inside the ink tank 50 provided with the sheet heater H is higher. This is because, when the flow rate of the ink is high, a larger amount of heat is taken from the sheet heater H so that the period of time required to equalize the temperature of the sheet heater H is shortened. The waiting time WT is, for example, about 20 (s).

When it is determined that the difference in temperature ΔToff is not equal to or higher than the abnormality threshold value T1 in step S17 (NO in S17), the controller 40 does not detect abnormality of the thermistor, and updates each of the abnormality threshold value T1(k) and the stop threshold value T2(k) from the default value (S19). Specifically, the controller 40 updates the abnormality threshold value T1(k) to be a value higher than the difference in temperature ΔToff (difference in temperature ΔToff calculated in step S17) after the waiting time WT(k) has elapsed (e.g., value of (ΔToff+3° C.)). The controller 40 updates the stop threshold value T2(k) to be a value higher than the difference in temperature ΔTon (difference in temperature Δton calculated in step S11) at the time of energization (e.g., value of (ΔTon+3° C.)). Thereafter, the updated stop threshold value T2(k) is used when the processing of step S11 is performed, and the updated abnormality threshold value T1(k) is used when the processing of step S17 is performed.

Next, the controller 40 determines whether an energization stop request of the sheet heater H(k) is received (S21). The controller 40 receives the energization stop request when there is no need to heat the sheet heater H(k), such as at the time of ending printing.

When it is determined that the energization stop request of the sheet heater H(k) is not received in step S21 (NO in S21), the controller 40 proceeds to the processing of step S7.

When it is determined that the energization stop request of the sheet heater H(k) is received in step S21 (YES in S21), the controller 40 determines whether the power source of the inkjet recording apparatus 1 is turned off (S23).

When it is determined that the power source of the inkjet recording apparatus 1 is turned off in step S23 (YES in S23), the controller 40 terminates the process.

When it is determined that the power source of the inkjet recording apparatus 1 is not turned off in step S23 (NO in S23), the controller 40 proceeds to the processing of step S3.

When it is determined that the difference in temperature ΔToff is equal to or higher than the stop threshold value T2(k) in step S17 (YES in S17), the controller 40 detects abnormality of the thermistor. The controller 40 notifies a user of the abnormality of the thermistor, and stops the energization control of the sheet heater H(k) (S25). Thereafter, the controller 40 terminates the process.

Note that the default value of the abnormality threshold value T1(k) and the stop threshold value T2(k) used in step Si is preferably lower as the interval P between the linear parts 612*a* of the heat generator 612 in the sheet heater H(k) is smaller, and is preferably lower as the target value Ti(k) in the idling mode is higher. This is because, since the heating speed of the ink by the sheet heater H is faster as the interval P between the linear parts 612*a* of the heat generator 612 is smaller and the margin of the difference in temperature between the target value Ti and the temperature at which the ink deteriorates is smaller as the target value Ti is higher, it is necessary to detect abnormality or suspected abnormality of the sheet heater H at a stage in which the temperature of the sheet heater H is lower.

Effect of Embodiment

According to the embodiment described above, abnormality of the thermistor is detected in the case where the difference in temperature ΔToff measured by each of the thermistors THa and THb exceeds the abnormality threshold value T1 after the waiting time WT has elapsed since the stop of the supply of power to the sheet heater H (since the stop of energization of the sheet heater H), whereby abnormality of the thermistor can be detected in the state where the difference in temperature caused by the positions at which the thermistors THa and THb are disposed is excluded. As a result, the accuracy in detecting abnormality of the thermistor can be enhanced without the need of unnecessarily increasing the abnormality threshold value.

Further, the abnormality threshold value T1 is updated to a value higher than the difference in temperature ΔToff when the difference in temperature ΔToff is smaller than the abnormality threshold value T1, and then abnormality of the thermistor is detected when the difference in temperature ΔToff exceeds the updated abnormality threshold value T1, whereby the abnormality threshold value with higher accuracy can be set according to the positions of the thermistors THa and THb.

Furthermore, the stop threshold value T2 is updated to a value higher than the difference in temperature Δton when the difference in temperature ΔT off is smaller than the abnormality threshold value T1, and then energization of the sheet heater H stops when the difference in temperature ΔTon exceeds the updated stop threshold value T2, whereby it becomes possible to avoid a situation in which the unnecessary abnormality detection process (steps S13 to S17) is performed despite the fact that the thermistors THa and THb are normal.

Moreover, the abnormality threshold value T1, the stop threshold value T2, and the waiting time WT can be set to optimum values for each of the N sheet heaters H(1) to H(N). This makes it possible to enhance the accuracy in detecting abnormality of the thermistor in each of the N sheet heaters H(1) to H(N).

The present inventors conducted the following experiments to confirm the effects described above.

FIG. 12 is a table illustrating a result of the abnormality detection of the thermistor according to an exemplary embodiment of the present invention.

Referring to FIG. 12, for each of exemplary embodiments of the present invention 1 to 5 in which the combination of the position of the thermistor and existence/non-existence of abnormality of the thermistor is different from each other, the energization of the sheet heater H was controlled in accordance with the flowchart illustrated in FIG. 11, and the result of the abnormality detection of the thermistor was obtained. The thermistor THa was set to be the thermistor for thermostatic control, and the thermistor THb was set to be the thermistor for abnormality detection.

In the exemplary embodiments of the present invention 1 and 2, as in the case C1 illustrated in FIG. 7A, both of the two thermistors THa and THb were disposed on the linear part 612*a* of the heat generator 612. In the exemplary embodiment of the present invention 1, thermistors that operate normally were used as the thermistors THa and THb. In the exemplary embodiment of the present invention 2, a thermistor that operates normally was used as the thermistor THa, and a thermistor that does not operate normally was used as the thermistor THb.

As a result, in the exemplary embodiment of the present invention 1, there was substantially no difference between the measured temperature TP1 of the thermistor THa and the measured temperature TP2 of the thermistor THb, and the difference in temperature ΔToff was less than the abnormality threshold value T1. As a result, no abnormality of the thermistor was detected, and a correct detection result was obtained. After the determination, each of the abnormality threshold value T1 and the stop threshold value T2 was updated to 3° C. In the exemplary embodiment of the present invention 2, the difference in temperature ΔTon exceeded the stop threshold value T2, and the difference in temperature ΔToff exceeded the abnormality threshold value T1. As a result, abnormality of the thermistor was detected, and a correct detection result was obtained.

In the exemplary embodiments of the present invention 3 to 5, as in the case C2 illustrated in FIG. 7B, one of the two thermistors THa and THb, which is the thermistor THa, was disposed on the linear part 612*a,* and the other thermistor THb was disposed between the two linear parts 612*a*. In the exemplary embodiment of the present invention 3, thermistors that operate normally were used as the thermistors THa and THb. In the exemplary embodiment of the present invention 4, a thermistor that operates normally was used as the thermistor THb, and a thermistor that does not operate normally was used as the thermistor THa. In the exemplary embodiment of the present invention 5, a thermistor that operates normally was used as the thermistor THa, and a thermistor that does not operate normally was used as the thermistor THb.

As a result, in the exemplary embodiment of the present invention 3, while the difference in temperature ΔTon was equal to or higher than the stop threshold value T2, the difference in temperature ΔToff was less than the abnormality threshold value T1. As a result, no abnormality of the thermistor was detected, and a correct detection result was obtained. After the determination, the abnormality threshold value T1 was updated to 4° C., and the stop threshold value T2 was updated to 8° C. In the exemplary embodiments of the present invention 4 and 5, the difference in temperature ΔTon exceeded the stop threshold value T2, and the difference in temperature ΔToff exceeded the abnormality threshold value T1. As a result, abnormality of the thermistor was detected, and a correct detection result was obtained.

In addition, although not illustrated in FIG. 12, when both of the two thermistors THa and THb were disposed between the two linear parts 612*a* and thermistors that operate normally were used as the thermistors THa and THb (exemplary embodiment of the present invention 6), the difference in temperature ΔTon was about 2.5° C., which was less than the stop threshold value T2. Further, the difference in temperature ΔToff was about 0.5° C., which was less than the abnormality threshold value T1. As a result, no abnormality of the thermistor was detected, and a correct detection result was obtained.

Others

One planar heat generator may be provided with three or more temperature sensors. In that case, abnormality of the temperature sensor is detected in the case where a difference in temperature measured by each of two temperature sensors out of the three or more temperature sensors exceeds the abnormality threshold value after a predetermined waiting time has elapsed since the stop of power supply to the planar heat generator.

The process in the embodiment described above may be performed by software, or may be performed using a hardware circuit. Further, a program for executing the process in the embodiment described above may be provided, or the program may be recorded in recording medium, such as a CD-ROM, a flexible disk, a hard disk, a ROM, a RAM, and a memory card, which is to be provided to a user. The program is executed by a computer such as a CPU. Furthermore, the program may be downloaded to an apparatus via a communication line such as the Internet.

Although embodiments of the present invention have been described and illustrated in detail, it should be considered that the disclosed embodiments are made for purposes of illustration and example only and not limitation in every respect. The scope of the present invention should be interpreted not by the descriptions above but by terms of the appended claims, and it is intended to include all modifications in the meanings equivalent to and within the scope of the claims.

What is claimed is:

1. A heater comprising:

a planar heat generator;

a power supply circuit that controls supply of power to the planar heat generator;

a plurality of temperature sensors that is provided on the planar heat generator and measures a temperature; and a hardware processor that detects abnormality of the temperature sensor in a case where a difference in temperature measured by each of two of the temperature sensors out of the plurality of temperature sensors exceeds an abnormality threshold value after a predetermined waiting time has elapsed since the supply of power to the planar heat generator is stopped.

2. The heater according to claim 1, wherein the hardware processor updates the abnormality threshold value in a case where the difference in temperature measured by each of the two temperature sensors is less than the abnormality threshold value after the waiting time has elapsed since the supply of power to the planar heat generator is stopped, the hardware processor detects, after the hardware processor has updated the abnormality threshold value, abnormality of the temperature sensor in a case where the difference in temperature measured by each of the two temperature sensors out of the plurality of temperature sensors exceeds the abnormality threshold value having been updated after the waiting time has elapsed since the supply of power to the planar heat generator is stopped, and the hardware processor updates the abnormality threshold value to a value larger than the difference in temperature measured by each of the two temperature sensors after the waiting time has elapsed since the supply of power to the planar heat generator is stopped.

3. The heater according to claim 1, wherein the hardware processor controls the power supply circuit to stop the supply of power to the planar heat generator in a case where the difference in temperature measured by each of the two temperature sensors exceeds a stop threshold value while power is supplied to the planar heat generator, the hardware processor updates the stop threshold value in a case where the difference in temperature measured by each of the two temperature sensors is smaller than the abnormality threshold value after the waiting time has elapsed since the supply of power to the planar heat generator is stopped, the hardware processor controls, after the hardware processor has updated the stop threshold value, the power supply circuit to stop the supply of power to the planar heat generator in a case where the difference in temperature measured by each of the two temperature sensors exceeds the stop threshold value having been updated while power is supplied to the planar heat generator, and the hardware processor updates the stop threshold value to a value larger than the difference in temperature measured by each of the two temperature sensors at a time when the hardware processor stops the supply of power to the planar heat generator.

4. A heater comprising:

a plurality of the heaters according to claim 1, wherein in each of the plurality of heaters, a temperature measured by at least one of the plurality of temperature sensors is maintained at a target value under a predetermined condition on a basis of control of the power supply circuit, the planar heat generator of each of the plurality of heaters includes:

an insulator; and a heat generator provided on the insulator, the heat generator includes each of a plurality of linear parts extending in parallel with each other at a predetermined interval, and a default value of the abnormality threshold value in each of the plurality of heaters is smaller as the interval is smaller, and is smaller as the target value is higher.

5. An inkjet printer comprising:

each of a plurality of ink holders that holds each of a plurality of different colors of ink;

each of a plurality of planar heat generators that is provided on each of the plurality of ink holders and heats each of the plurality of ink holders;

each of a plurality of power supply circuits that controls supply of power to each of the plurality of planar heat generators;

each of a plurality of temperature sensors that is provided on each of the plurality of planar heat generators and measures a temperature; and a hardware processor that detects abnormality of the temperature sensor in a case where a difference in temperature measured by each of two of the temperature sensors out of the plurality of temperature sensors exceeds an abnormality threshold value after a predetermined waiting time has elapsed since the supply of power to each of the plurality of planar heat generators is stopped.

6. The inkjet printer according to claim 5, wherein the waiting time in each of the plurality of planar heat generators is shorter as a flow rate of ink inside the ink holder provided with the planar heat generator is higher.

7. The inkjet printer according to claim 6, wherein each of a plurality of the hardware processors obtains the flow rate of ink inside each of the plurality of ink holders, and the waiting time in each of the plurality of planar heat generators is set according to the flow rate of ink obtained by the hardware processor corresponding to the planar heat generator.

* * * * *